US005572295A

United States Patent [19]

Sakagami et al.

[11] Patent Number: 5,572,295

[45] Date of Patent: Nov. 5, 1996

[54] VOLTAGE CONTROL DEVICE FOR A CHARGE

[75] Inventors: Hidekazu Sakagami; Masahiro Tsutsumi; Masaru Watanabe; Hiroyuki Hazama; Hidehiro Tabuchi; Kazuhiro Mizude; Junichi Oura; Yukio Hashimoto, all of Osaka, Japan

[73] Assignee: Mita Industrial Co., Ltd., Osaka, Japan

[21] Appl. No.: 370,436

[22] Filed: Jan. 9, 1995

[30] Foreign Application Priority Data

| | | | |
|---|---|---|---|
| Jan. 14, 1994 | [JP] | Japan | 6-002557 |
| Jan. 14, 1994 | [JP] | Japan | 6-002558 |
| Jan. 14, 1994 | [JP] | Japan | 6-002584 |
| Jan. 14, 1994 | [JP] | Japan | 6-002585 |

[51] Int. Cl.[6] ..... G03G 15/02

[52] U.S. Cl. ..... 399/50

[58] Field of Search ..... 355/221, 225, 355/227, 216, 219

[56] References Cited

U.S. PATENT DOCUMENTS

| | | | |
|---|---|---|---|
| 4,636,060 | 1/1987 | Schamphelaere et al. | 355/221 |
| 4,920,380 | 4/1990 | Ueda et al. | 355/219 |
| 5,060,017 | 10/1991 | Ueda | 355/221 |
| 5,161,084 | 11/1992 | Morihara et al. | 361/225 |
| 5,416,564 | 5/1995 | Thompson et al. | 355/208 |

FOREIGN PATENT DOCUMENTS

0525616A3 2/1993 European Pat. Off. .

OTHER PUBLICATIONS

Patent Abstracts of Japan, vol. 015, No. 055 (p–1164), Feb. 8, 1991 JP/2–284172.

Patent Abstracts of Japan, vol. 010, No. 305 (p–507), Oct. 17, 1986 JP/61–120175.

Patent Abstracts of Japan, vol. 017, No. 485 (P–1605), Sep. 2, 1993 JP/5–119554.

IBM Technical Disclosure Bulletin, vol. 19, No. 7, Dec. 1976, pp. 2448–2449.

*Primary Examiner*—Nestor R. Ramirez

*Attorney, Agent, or Firm*—Beveridge, DeGrandi, Weilacher & Young, LLP

[57] ABSTRACT

In a copying processing performed several times from the depression of a copy button of a copying machine until the surface potential of the photoreceptor drum is stabilized, a voltage sufficiently high for correcting the rise characteristic of the photosensitive layer on the drum surface is applied to a charger. A main circuit having a controlling portion to realize this corrects the output voltage of the high-voltage generating circuit which applies a high voltage to the charger to a voltage value necessary for the drum surface to be charged at a stable potential level. The main circuit charges the drum surface at the stable potential level necessary for development from copying of the first sheet.

13 Claims, 12 Drawing Sheets

VOLTAGE CONTROL DEVICE FOR A CHARGE

BACKGROUND OF THE INVENTION

1. Field of the Invention

The present invention relates to an image forming apparatus such as an electrographic copying machine, a printer apparatus and a facsimile apparatus of a type in which after an electrostatic latent image is formed on a charged surface of a latent image carrier such as a photoreceptor drum, the electrostatic latent image is developed into a toner image, and more particularly, to the correction of rise of the surface potential of the latent image carrier in the beginning of image formation.

2. Description of the Prior Art

Generally, in an electrographic copying machine there is provided, for example, a photoreceptor drum rotating at a constant speed, and along the rotation direction of the drum, a charging section, an exposing section, a developing section, a transferring section, a cleaning section and a charge removing section are arranged. First, the drum surface is charged at the charging section, then, the drum rotates, and when the charged drum surface passes the exposing section, light reflected in the scanning of the original exposes the drum surface. By the exposure light, an electrostatic latent image is formed on the drum surface.

When the drum rotates to the developing section, toner supplied from a developer unit arranged to face the drum surface adheres to the electrostatic latent image on the drum surface, so that a toner image is obtained. The toner image is transferred at the transferring section to the surface of a sheet supplied from a paper feeding section. After the transfer, residual toner on the drum surface is removed at the cleaning section, and the electrostatic latent image on the drum surface is removed by irradiating charge removing light to the entire drum surface at the charge removing section to optically attenuate the surface potential of the drum surface.

In the electrographic copying machine of the above-described arrangement, a charger employing a corona discharge method is arranged in the charging section to face the drum surface. At the time of the charging, a charge is supplied to the drum surface by applying high voltage of approximately 4 to 6 kV to a discharging main wire of the charger to generate a corona discharge. According to a conventional method, to supply the high voltage to the main wire, a transformer board having a transformer for generating a high voltage is provided between the main wire and a power source, and the transformer board is controlled so that its output is substantially constant.

According to such a charging method, the rise of the surface potential in the beginning of copying differs depending on the type of photosensitive material formed on the surface of the photoreceptor drum. Specifically, as shown in FIG. 7, when a copy button is pressed to start a copying operation in the waiting state of the copying machine, the high voltage is applied to the charger as described above, so that a charge is supplied to the drum surface. At this time, when arsenic selenium is used as the photosensitive material, the rise of the surface potential is made as shown by the broken line a of FIG. 7 such that the potential overshoots to temporarily exceed a stable potential and then returns to the stable potential to remain stable.

On the contrary, when an amorphous silicon is used which has been widely used as the photosensitive material of image forming apparatuses of this type in recent years, as shown by the solid line b of FIG. 7, it takes a long time for the potential to reach the stable potential after a copy button is pressed, i.e. the rise characteristic is inferior. In addition, it is known that with such a photosensitive material, the rise of the surface potential further deteriorates as shown by the solid line c of FIG. 7 according to the left period from the end of a copying process to the start of the next copying process.

In recent years, the time required for the first copying has been reduced to improve the copying efficiency. In a copying machine of a conventional arrangement where such an amorphous silicon material is used as the photosensitive material, as shown in FIG. 7, when the first copying is performed, the potential on the drum surface is still lower than the stable potential. For this reason, the charge amount of the electrostatic latent image is insufficient, so that an excellent toner image cannot be developed at the developing section. In addition, when the left period from the end of the copying process to the start of the next copying process exceeds one hour, the rise of the surface potential further deteriorates. For this reason, the charge amount of the electrostatic latent image is insufficient, so that an excellent toner image cannot be developed at the developing section.

Further, when continuous copying is performed in such an arrangement, the surface potential of the drum is low during the copying of the first and subsequent several sheets, and it is difficult to obtain a copy image of a desired quality before the copying of the several sheets are performed, i.e. before the drum surface potential reaches a normal value.

SUMMARY OF THE INVENTION

An object of the present invention is to provide an image forming apparatus which improves the inferiority in rise of the surface potential of the electrostatic latent image carrier in the beginning of image formation so that an image of an excellent quality is obtained from the copying of the first sheet.

The present invention is directed to an image forming apparatus provided with an electrostatic latent image carrier having a photosensitive layer formed on its surface and moving from a charging section at least to an exposing section, a developing section and a charge removing section in this order to return to the charging section, and operation means for starting an image forming operation, wherein an image forming process is performed arbitrary times in which by turning on the operation means, a surface of the electrostatic latent image carrier is charged by a charger provided in the charging section, an electrostatic latent image is formed on the charged surface of the electrostatic latent image carrier at the exposing section, a toner image of the electrostatic latent image is formed at the developing section, and the charge is removed at the charge removing section to be ready for the next charging.

To achieve the above-mentioned object, according to the present invention, voltage applying means for applying a voltage to the charger to provide a charge to the surface of the electrostatic latent image carrier, and controlling means are provided to the image forming apparatus. While the charging operation is performed several times until the surface potential is changed from a potential lower than a stable potential due to a rise characteristic of the surface potential of the electrostatic latent image carrier to the stable potential after the start of the image forming process, the controlling means corrects the output value of the voltage applying means to a voltage value necessary to charge the surface of the electrostatic latent image carrier at a stable potential level.

When an amorphous silicon photosensitive material is used as the surface photosensitive layer of the electrostatic latent image carrier, the above-mentioned features are effective in improving the rise of the surface potential of the electrostatic latent image carrier.

According to such features, until the surface potential of the electrostatic latent image carrier is stabilized from the copying of the first sheet after the activation of the operation means, when the image forming process is executed, the output value of the voltage applying means is corrected to a voltage value necessary for charging the surface of the electrostatic latent image carrier at a stable potential level by the controlling means. As a result, a high voltage sufficient to correct the rise characteristic of the surface potential of the electrostatic latent image carrier is applied to the charger.

Therefore, the surface of the electrostatic latent image carrier is charged at a stable potential level necessary for development, and in a machine using an electrostatic latent image carrier having a photosensitive layer made of a photosensitive material having a low rise characteristic, an excellent image quality is realized from the first image formation.

BRIEF DESCRIPTION OF THE DRAWINGS

This and other objects and features of this invention will become clear from the following description, taken in conjunction with the preferred embodiments with reference to the accompanied drawings in which.

DESCRIPTION OF THE PREFERRED EMBODIMENTS

Figure 1:
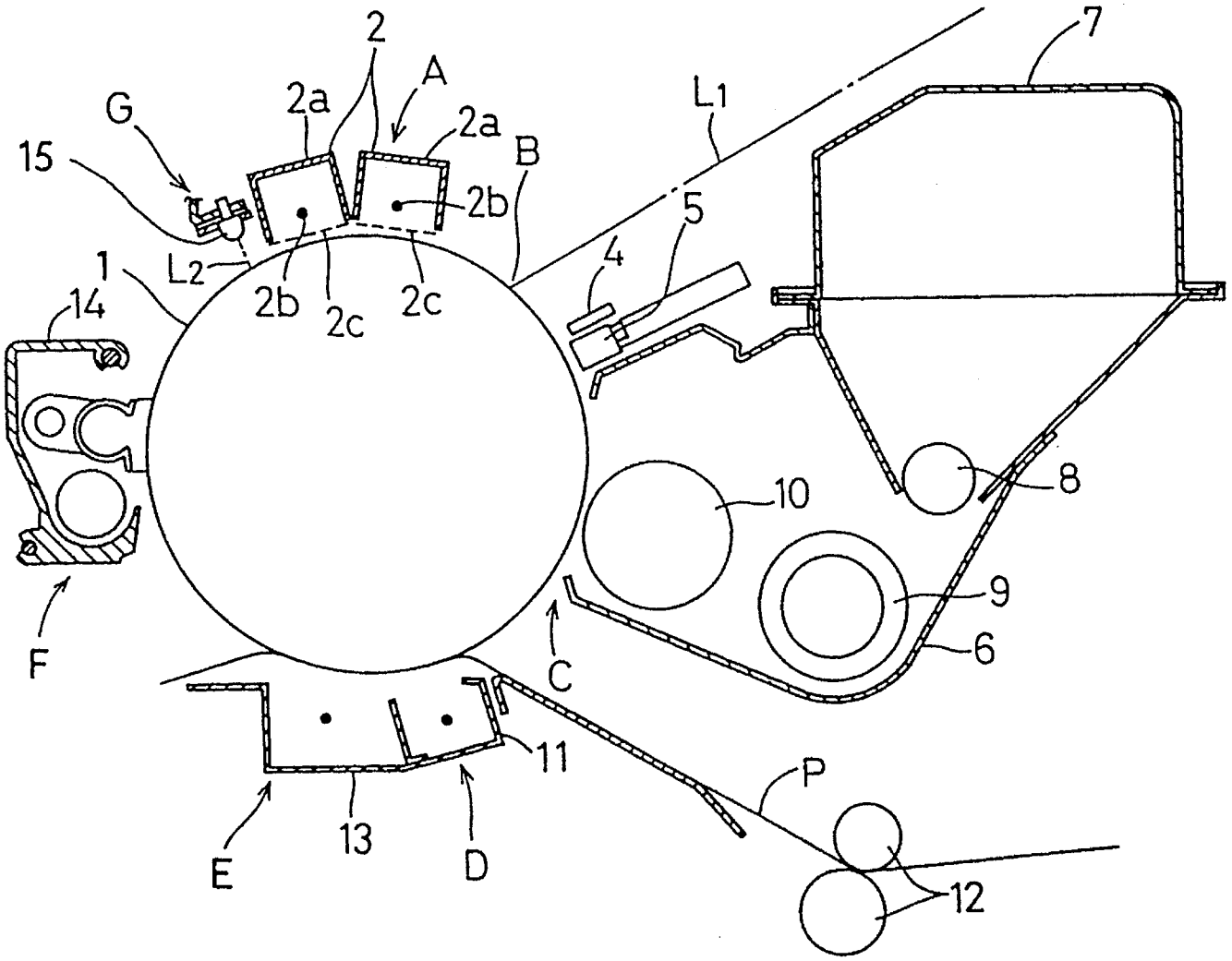
FIG. 1 is a front view schematically showing the arrangement of a relevant portion of an embodiment of the present invention.

Hereinafter, an embodiment where an image forming apparatus of the present invention is employed in an electrographic copying machine will be described with reference to the drawings. Referring to FIG. 1, there is schematically shown the arrangement of an electrographic copying machine according to this embodiment. Reference numeral 1 represents a photoreceptor drum serving as an electrostatic latent image carrier. The drum 1 includes a drum base body made of a metal such as aluminum on which an amorphous silicon photosensitive material is deposited, and rotates clockwise in the figure at a constant speed.

In the periphery of the drum 1, a charging section A, an exposing section B, a developing section C, a transferring section D, a separating section E, a cleaning section F and a charge removing section G are arranged in this order in the rotation direction (movement direction) of the drum 1.

At the charging section A, a pair of chargers 2 are arranged adjacent to each other. The chargers 2 are arranged to look toward the axial center of the drum 1 and close to the drum surface to face it. The surfaces of the chargers 2 facing the drum 1 are open. In a shield case **2*a* arranged in parallel with the drum axis, a main wire 2*b* composed of a fine wire made of tungsten is stretched along the length of the shield case 2*a*, and a grid electrode 2*c* is arranged on the opened surface of the shield case 2*a***.

Figure 2:
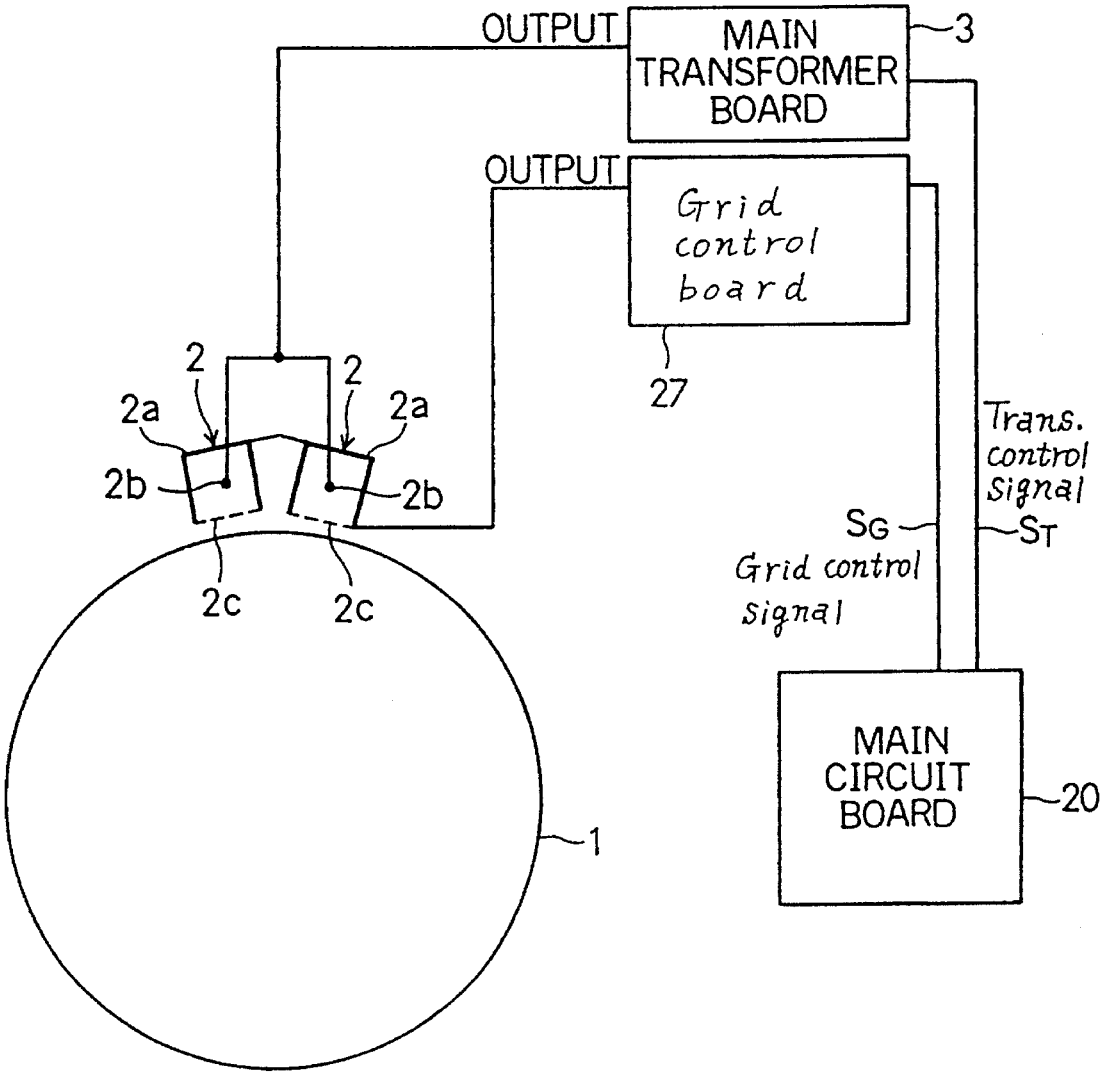
FIG. 2 is a structural view schematically showing a control system of each charger.

Referring to FIG. 2, there is shown a control system of the chargers 2. As shown in the figure, the main wires **2*b* are connected to a main transformer board 3 serving as a voltage applying means, and a high voltage of approximately 4 to 6 kV is applied by an output of the main transformer board 3. The board 3 includes a transformer for generating a high voltage. Returning to FIG. 1, when the high voltage is applied to the chargers 2 by the main transformer board 3, a corona discharge is generated to supply a charge to the drum surface. The surface potential of the drum 1** thus charged is normally approximately 1000V.

When the drum 1 rotates and reaches the exposing section B, a reflected light $L_1$ of an original image is irradiated on the charged surface of the drum 1 through a non-illustrated optical system to expose the surface of the drum 1. In this case, the surface potential of only the exposed portion is reduced by optical attenuation in correspondence with the exposure amount, so that an electrostatic latent image is formed.

A surface electrometer 4 is arranged just in front of the developing section C in the drum rotation direction. The count value of the surface electrometer 4 is used for setting as a target value the charging potential of the drum surface at the developing section C. Since the potential of the drum surface charged at the charging unit A is dark-decayed while the drum 1 is rotating to the developing section C, the surface potential is reduced to approximately 820V when the drum surface reaches the developing section C. Specifically, the surface potential at the developing section C is necessarily approximately 820V, and the voltage applied to the chargers 2 at the charging section A is set so that the surface is charged to a potential (1000V) allowing for the dark decay. In other words, in order that the surface potential of the drum surface at the developing section C is the target value 820V, the measurement value of the surface potential at the potential sensor 4 is necessarily 850V. Therefore, the charging potential of the charging section A is set to 1000V so that the measurement value is 850V. The setting of the voltage will be described later.

Reference numeral 5 represents an image erasing blank lamp arranged adjacent to the surface electrometer 4. The blank lamp 5 is constituted by arrays of light emitting diodes (LEDs). When the user intends to erase a part of an electrostatic latent image for a purpose such as specifying an image area, the blank lamp 5 selectively turns on necessary LEDs so that the portion of the electrostatic latent image irradiated by the LEDs is optically attenuated and erased.

At the developing section C, a developer unit 6 and a toner hopper 7 which supplies toner to the developer unit 6 are arranged. With this arrangement, toner contained in the toner hopper 7 is supplied into the developer unit 6 by a predetermined amount through a sponge roller 8. The toner and carrier (iron powder) are agitated by an agitating roller 9 in the developer unit 6, and the toner held by the carrier adheres to the surface of the developing roller 10. When the portion of the drum 1 on which an electrostatic latent image is formed reaches the developing section C, the toner in the developer unit 6 electrically adheres to the drum surface according to the electrostatic latent image through the developing roller 10. Thereby, a toner image is formed.

At the transferring section D, a transfer charger 11 is arranged. When the drum 1 reaches the transferring section D, a sheet P is fed onto the drum surface through paper feeding rollers 12 of the paper feeding section, and a voltage of a polarity opposite to that of the toner is applied to the transfer charger 11 to transfer the toner image formed on the drum surface to the sheet P. At the separating section E, a separating charger 13 is arranged. The separating charger 13 applies an AC electrical field to the drum surface to thereby release the sheet P from being attracted to the drum 1, so that the sheet P on which the toner image has been transferred is separated from the drum 1.

At the cleaning section F, a cleaning unit 14 is arranged. The cleaning unit 14 removes things such as toner adhering to the drum surface from the drum surface by scrubbing the drum surface. The residual toner on the drum surface reaches the cleaning portion F and is removed by the cleaning unit 14. Then, at the charge removing section G, a charge irradiating light $L_2$ of a charge removing lamp 15 irradiates the drum surface to optically attenuate the surface potential of the drum 1, so that the charge is removed.

Then, the drum 1 returns to the charging section A to be ready for the next copying operation. When the continuous copying is set, the above-described copying process is repeated at arbitrarily set times.

Figure 7:
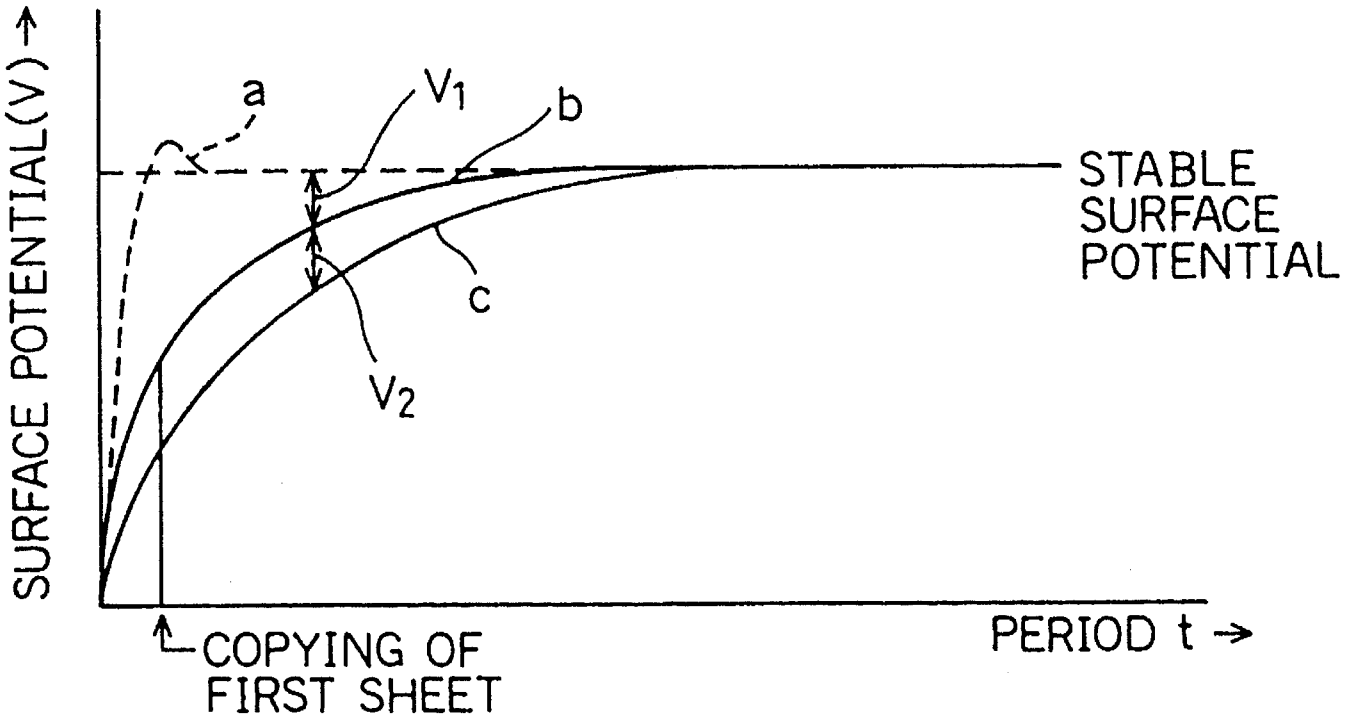
FIG. 7 is a diagram showing the rise condition of the surface potential of a photoreceptor drum having a photosensitive layer made of an amorphous silicon material at the time of the voltage application.

In the electrographic copying machine of the above-described arrangement, an amorphous silicon material is used as the photosensitive layer of the drum 1 as described above, so that the rise of the surface potential in the beginning of the copying operation is low as shown by the solid line b of FIG. 7. Further, it is known that with such a photosensitive material, the rise of the surface potential worsens according to the period of time during which the copying machine is left unoperated as shown by the solid line c of FIG. 7.

Figure 3:
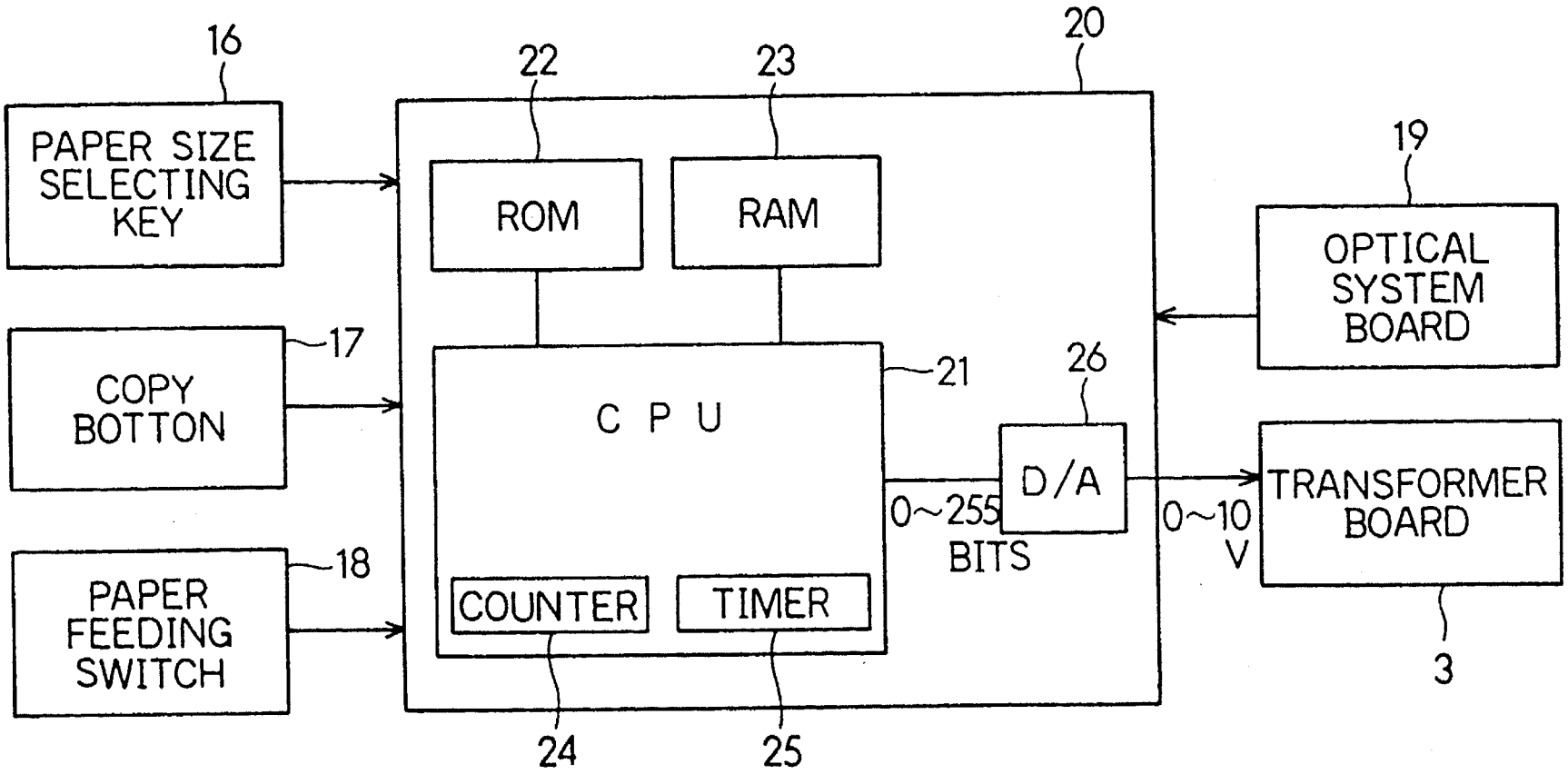
FIG. 3 is a block diagram showing a control system and an operation system of the copying machine.

In this embodiment, in order to correct the above-mentioned rise characteristic and left period characteristic in the beginning of the copying operation in a copying machine using an amorphous silicon photosensitive material, the control system and the operation system of the copying machine are arranged as shown in FIGS. 2 and 3. In the figures, reference numeral 16 represents a paper size selecting key used to select a size among the sizes shown in Table 1. Reference numeral 17 represents a copy button serving as the operation means used to start a copying operation. By pressing the copy button 17, the above-described copying process is executed. Reference numeral 18 represents a paper feeding switch provided in the vicinity of the paper feeding rollers 12. Reference numeral 19 represents an optical system board for controlling the optical system.

Reference numeral 20 represents a main circuit board provided with a microcomputer. The main circuit board 20 is provided with a central processing unit (CPU) 21, a read only memory (ROM) 22 and a random access memory (RAM) 23 for inputting and outputting control data to the CPU 21. In the CPU 21, a counter 24 for counting the number of copyings based on a detection signal of the paper feeding switch 18 and a timer 25 for counting the left period are arranged in the form of software.

After the copying process is started, the CPU 21 controls the program so that a transformer output control signal for correcting an output value of the main transformer board 3 to a voltage value necessary for charging the drum surface at a stable potential level is transmitted to the main transformer board 3 through a digital to analog (D/A) converter 26 incorporated in the main circuit board 20 based on input data from the paper size selecting key 16, the copy button 17 and the paper feeding switch 18 in the charging operation performed predetermined times until the surface potential of the drum 1 reaches the stable potential level shown in FIG. 7.

Specifically, as shown in FIG. 7, at the time of the charging of the copying process from the first copying to the time when the surface potential of the drum surface reaches a stable potential level, the surface potential is corrected by the sum of a potential difference $V_1$ between the drum surface potential value at that time and the stable potential due to the rise characteristic of the drum 1 (hereinafter, referred to as drum characteristic) having a photosensitive layer made of an amorphous silicon photosensitive material, and a potential difference $V_2$ between the drum surface potential value at that time due to a left period when the copying machine is left unoperated for some period of time and the surface potential value due to the drum characteristic.

Figure 4:
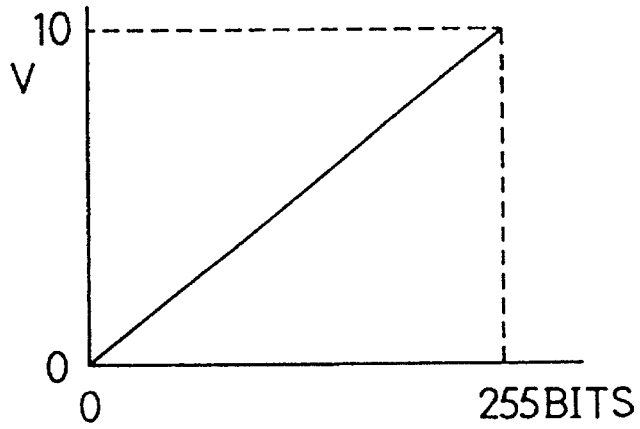
FIG. 4 is a diagram showing a relationship between an output value and a D/A converted value of the CPU.

Referring to FIG. 4, there is shown a relationship between a digital data input value and an analog output value at the D/A converter 26 in this case. As shown in the figure, the digital data input (i.e. the output of the CPU 21) is set to 0 to 255 bits, and a transformer output control signal which is a D/C-converted value proportionally corresponds to 0 to 10V.

Figure 5:
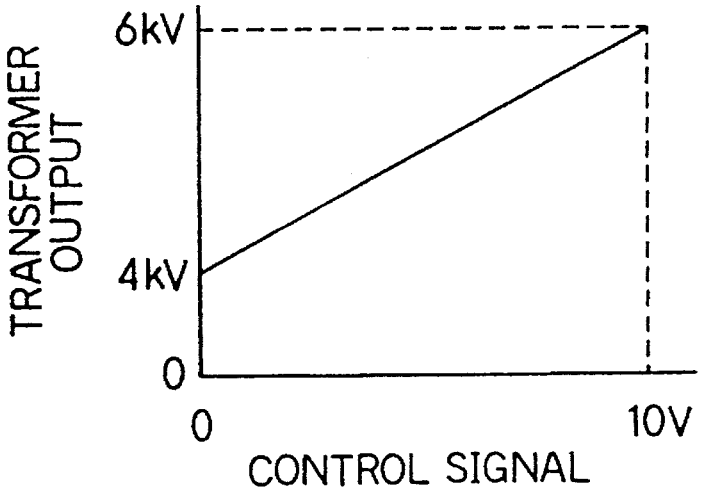
FIG. 5 is a diagram showing a relationship between a control signal and a transformer output.

Referring to FIG. 5, there is shown a relationship between a D/A-converted transformer output control signal and a transformer output of the main transformer board 3. As shown in the figure, the output of 0 to 10V of the transformer output control signal outputted from the main circuit board 20 proportionally corresponds to the voltage of 4 to 6 kV applied to the chargers 2 by the main transformer board 3.

Figure 6:
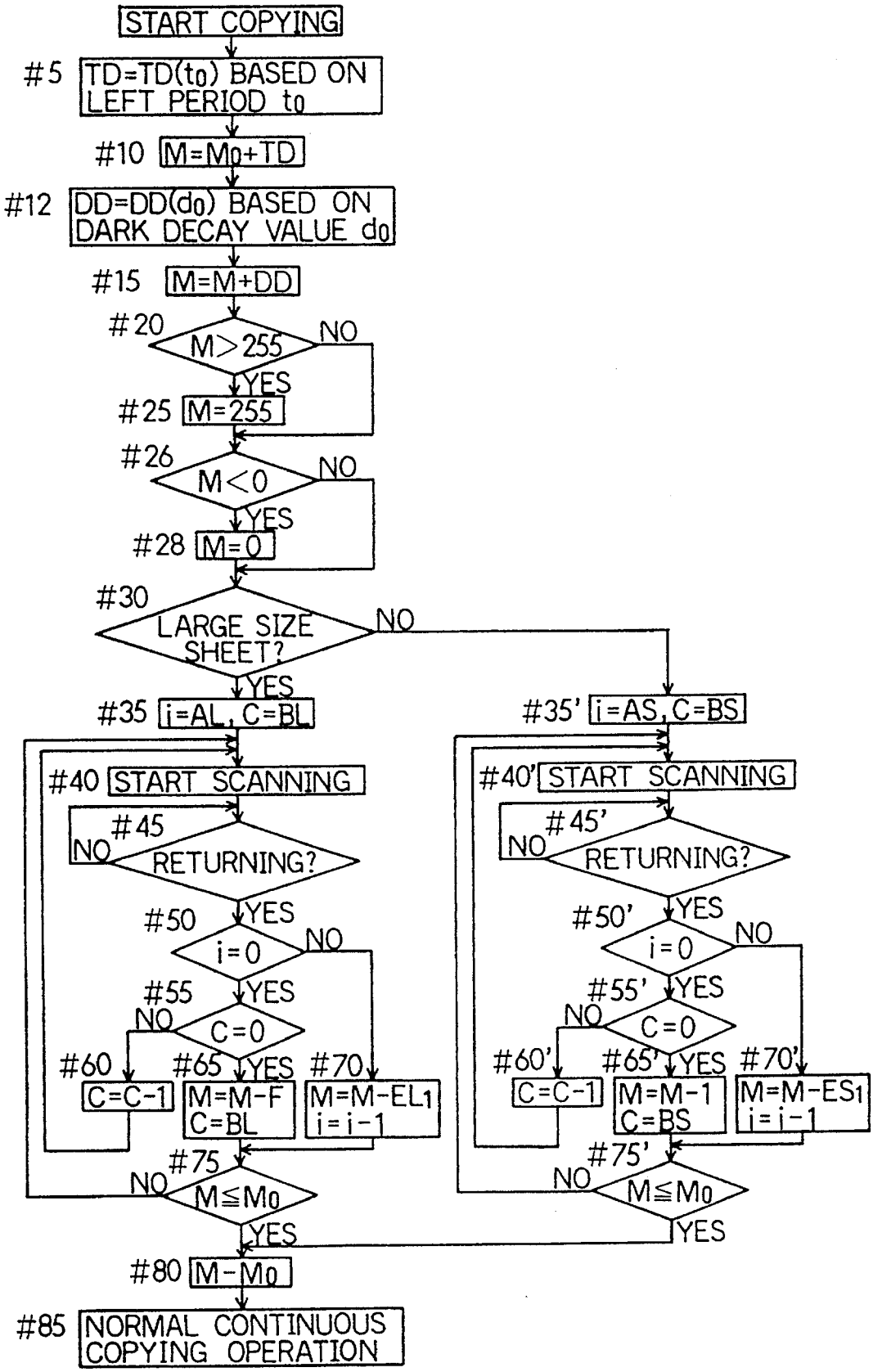
FIG. 6 is the flowchart of a control operation of the CPU.

Referring to FIG. 6, there is shown the flow of a control operation performed by the CPU 21 of the main circuit board 20. As shown in the figure, when the copy button 17 is turned on to start a continuous copying operation, the number of copyings is detected by the counter 24 and a left period $t_0$ for which the copying machine has been left unoperated since the end of the last copying operation is detected based on the counting by the timer 25.

Then, at step #5, a left period characteristic addition data TD corresponding to the left period $t_0$ is selected from a table data. In this case, when the left period is, for example, three minutes, the CPU 21 takes out a data corresponding to the left period of three minutes from the table data incorporated in the ROM 22.

At step #10, a control value M of the transformer output during copying is obtained by adding the left period characteristic addition data TD to a set control value $M_0$ of the transformer output. The control values M and $M_0$ are counted in bit value on software, and the data TD increases in the form of a bit number the correction amount corresponding to the value of $V_2$ at that time shown in FIG. 7.

At steps #12 and #15, the control value M of the transformer output during copying is obtained by selecting a drum characteristic addition data DD corresponding to a dark decay value $d_0$ particular to the drum from the data table and adding it to the value M obtained by adding the data TD at step #10. The drum characteristic addition data DD, which is stored in the form of a bit number in the ROM 22 in this case, increases in the form of a bit number the correction amount corresponding to the value of $V_1$ at that time shown in FIG. 7.

When it is determined at step #20 that the control value M exceeds a maximum permissible value (Max: 255 bits) as a result of the addition of step #15, the control value M is set to the maximum permissible value, i.e. 255 bits. This value is 10V after the D/A conversion as is apparent from FIG. 4. Therefore, the voltage applied to the main wires **2*b* of the chargers 2 is set to 6 kV by the main transformer board 3 based on the relationship shown in FIG. 5. When it is determined at step #26 that the control value M falls below the minimum permissible value (Min: 0 bit), at step #28, the control value M is set to the minimum value, i.e. 0. This value is, as is apparent from FIG. 4, 0V after the D/A conversion. Therefore, the voltage applied to the main wire 2*b* of the charger 2 is set to 4 kV by the main transformer board 3 based on the relationship shown in FIG. 5**.

At step #30, the subtraction control is branched based on paper size data inputted from the paper size selecting key 16. In this case, data classified into large and small sizes as shown in Table 1 (see below) are stored in the ROM 22 with a predetermined sheet size as the reference. For example, when the original is copied to an A3-size sheet, it is determined that the sheet is of a large size as shown in Table 1 and the process proceeds to step #35. Moreover, when the sheet is of A4 size, it is determined that the sheet is of a small size and the process proceeds to step #35'.

At step #35, a count variable is set in correspondence with the large size sheet. Specifically, an initial copy number count variable i is set to an initial copy number count value AL of the large size sheet, and an interval count variable C is set to an interval count value BL of the large size papers. In this case, the initial copy number count variable i corresponds to the copy number and relates mainly to the drum characteristic as described later. The interval count variable C corresponds to a jump number during copying and relates mainly to the left period characteristic as described later.

At step #40, the optical system board 19 is operated to start the scanning of the original. At this time, at step #45, the output control value M of the main transformer board 3 is changed after a returning operation of the optical system is sensed. The process to change the output control value is executed at the succeeding steps.

Specifically, at step #50, it is determined whether or not the subtraction of the drum characteristic correction value DD and the left period TD is finished up to the initial copy number count value AL. In this case, when i=0 where the count has reached the set copy number, the process proceeds to the next step #55. When the count has not reached the set copy number, at step #70, the drum characteristic correction value DD and the left period correction value TD are subtracted according to the copy number. That is, the bit number is successively reduced for every copy number according to a data obtained by adding a characteristic c depending to the left period to the drum characteristic b shown in FIG. 7.

For example, when the sum of the selected drum characteristic addition data DD and the left period characteristic addition data TD is 10 bits and the initial copy number count variable i is 3, large size sheet subtraction data $EL_3$=6, $EL_2$=3 and $EL_1$=1 are obtained from the table data stored in the ROM 22.

The sum of the data $EL_3$, $EL_2$ and $EL_1$ coincides with the sum of the drum characteristic addition data DD and the left period characteristic addition data TD. As a result, at the copying of the first sheet, the transformer output control signal shown in FIG. 2 is increased by 10 bits in correspondence with the both characteristics, and at the copying of the second sheet, the transformer output control signal is increased by 10–6=4 bits. At the copying of the third sheet, the signal is increased by 4–3=1 bit, and at the copying of the fourth sheet, the signal is outputted without being increased (1–1).

After the subtraction of the drum characteristic correction value DD and the left period correction value TD is finished for AL at step #50, the process proceeds to step #55. At step #55, for example, when the interval count variable C is for example 3, C is set to C–1 at step #60 and the process returns to step #40. This is repeated three times and at the fourth copying, a left period correction value F for every set copy number is subtracted at step #65. That is, the control value M is decreased by F bits as an addition data every four copyings.

The transformer output control value M obtained by the operations of steps #65 and #70 is compared with the initial set value $M_0$ at step #75. The process returns to step #40 to repeat the correction of the drum characteristic and the left period characteristic until the value M equals the set value $M_0$ or the surface potential of the drum surface reaches the stable potential without any need for correction. When the transformer output control value M is equal to or below the initial set value $M_0$ at step #80, the process returns to the normal continuous copying operation at the set control value $M_0$ at step #85.

When a small size sheet is used at step #30, the process proceeds to step #35' to perform the transformer output control value controlling operation up to step #75. This operation will not be described since it is the same as the above-described operation performed when a large size sheet is used.

In the case of the small size sheet, however, the time required for the copying of one sheet is shorter than in the case of the large size sheet, so that the subtraction of the drum characteristic and left period characteristic for every copying is fractional. At step #35', AS represents an initial copy number count value, and BS represents an interval count value of the small size sheet. ESi at step #70' represents the sum of the drum characteristic addition data and the left period addition data for the small size sheet.

To stabilize the drum surface potential at the developing section C, the main circuit board 20 regulates the potential when the power is activated. Specifically, as shown in FIG. 2, the grid electrode **2*c* of each charger 2 is provided for the potential regulation and connected to the main circuit board 20 through a grid control board 27. The board 27** includes a grid voltage supplying circuit.

The grid control board 27 is controlled by a grid potential control signal transmitted from the main circuit board 20 so that the drum surface potential is a predetermined value (e.g. 820V) at the developing section C, and by regulating the grid voltage thereby, the drum surface potential at the charging section A is controlled. In this case, when the regulation is impossible even if the grid control signal is changed to the limit of the variable range by the grid control board 27, the transformer output is also controlled by the main circuit board 20.

In the above-described embodiment, the voltage applied to the charger 2 is controlled mainly by a transformer control signal transmitted to the main transformer board 3 through the D/A converter 26 incorporated in the main circuit board 20. However, as another embodiment, the grid voltage may be used to mainly control the charger in order to correct the surface voltage of the drum. In this case, a grid voltage supplying circuit mounted on the grid control board 27 generates a voltage within a larger range. The circuit is controlled by an output of the main circuit board 20.

Figure 8:
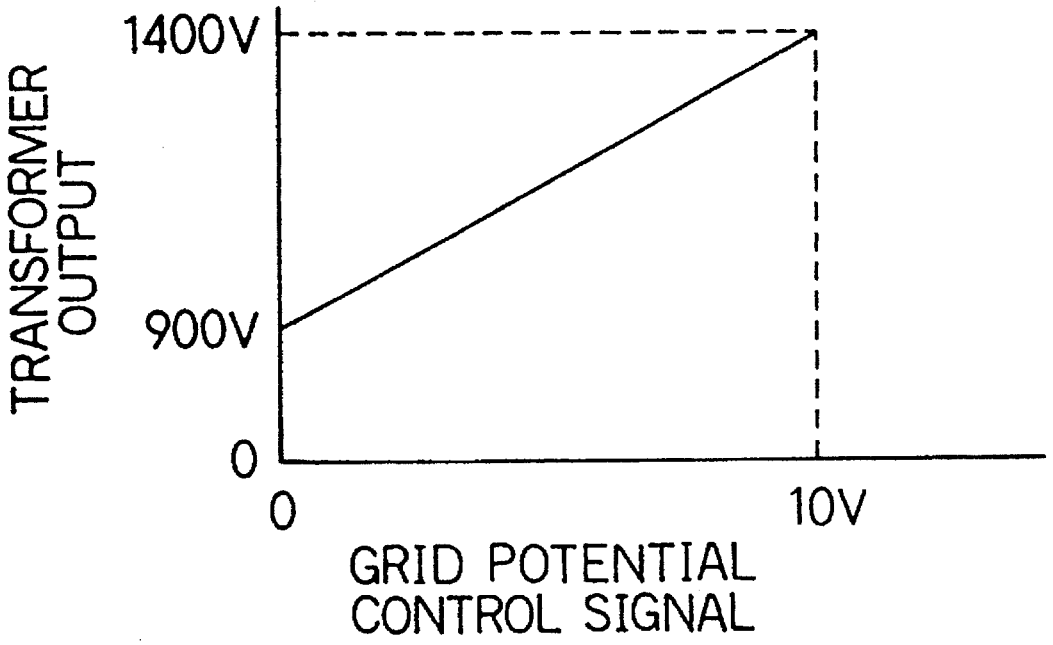
FIG. 8 shows a relationship between a grid potential control signal and a transformer output.
Figure 9:
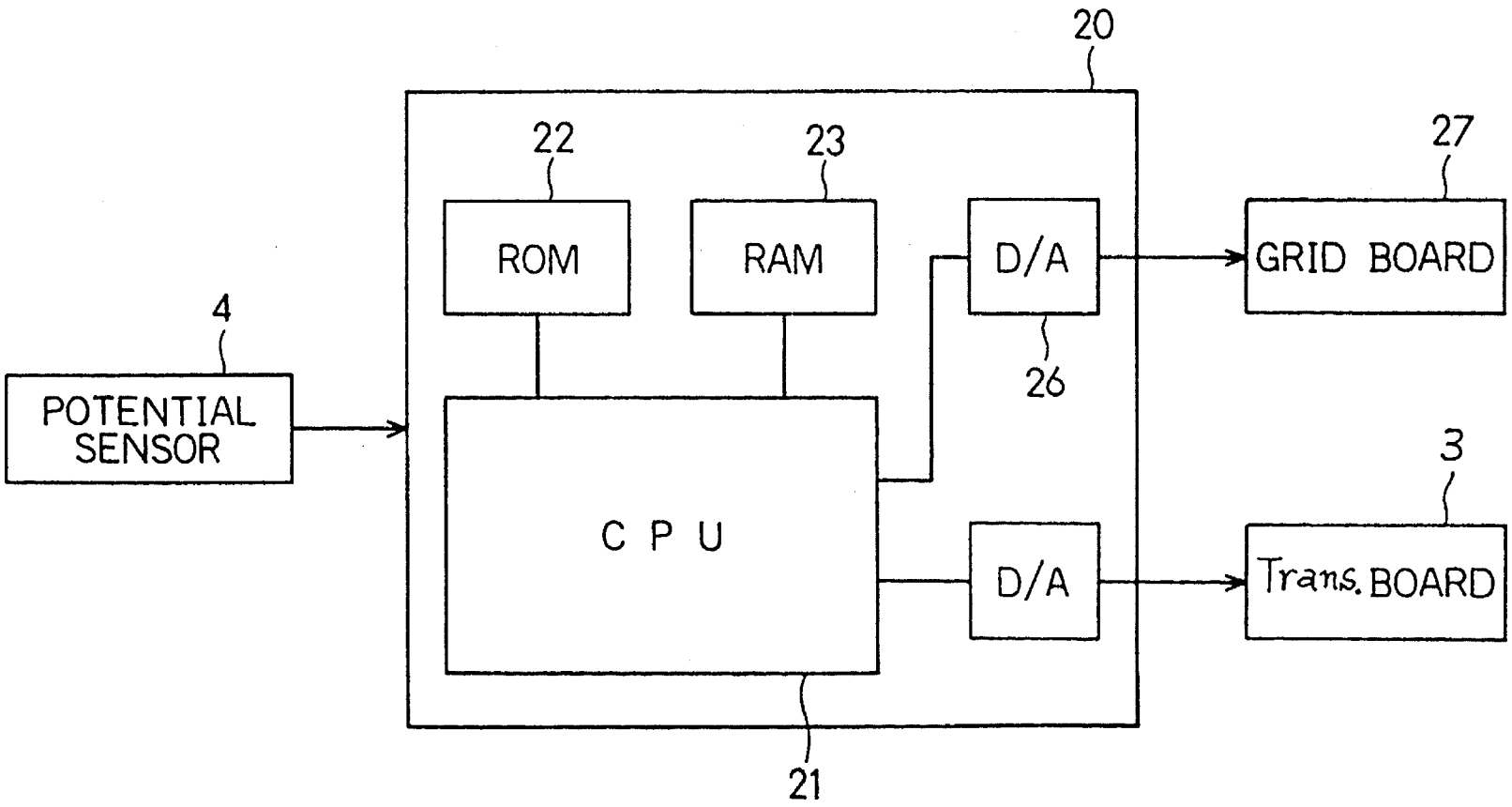
FIG. 9 is a block diagram showing a control system and an operation system of another embodiment of the present invention.

Referring to FIG. 8, there is shown a relationship between a D/A converted transformer output control signal and a grid control signal. As shown in this figure, 0 to 10V of the grid control signal outputted by the main circuit board 20 proportionally correspond to the voltages 900 to 1400V applied to the main wire 2*b* by the board 3. The drum surface potential is set to a predetermined potential by supplying a constant transformer output to each charger 2 and by controlling the grid voltage via board 27 by the grid potential control signal. Thus, the same effect is obtained by performing the control operation by using the control value M of the transformer output of FIG. 6 as the control value of the grid electrode 2*c*. FIG. 9 shows the block circuit diagram of this embodiment. The same elements and portions as those of the embodiment of FIGS. 2 and 3 are identified by the same reference designations.

Figure 10:
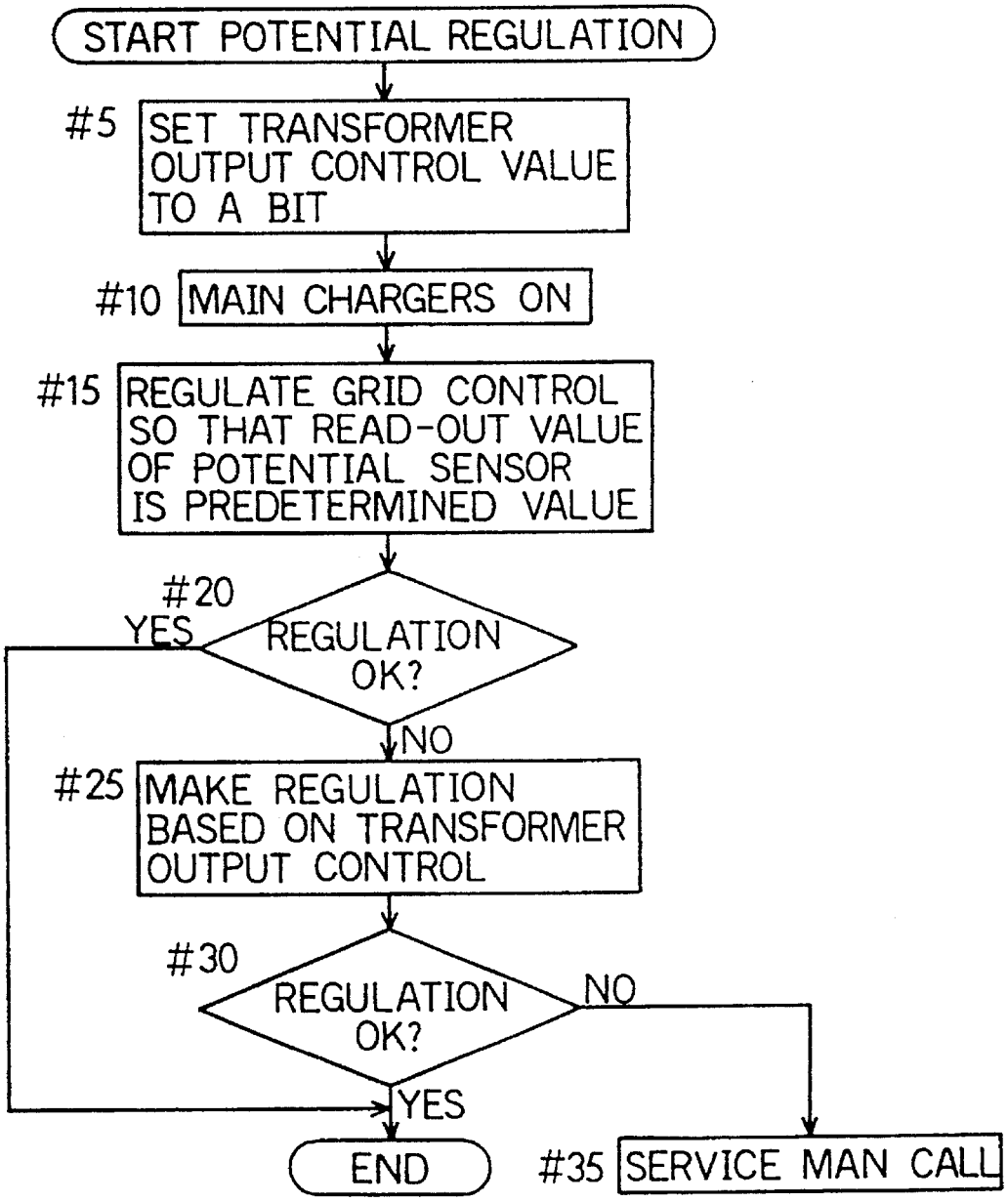
FIG. 10 is the flowchart of its control operation.

While the method using the grid voltage can be performed by the control operation of FIG. 6, it may be performed by a control operation as shown in FIG. 10. As shown in FIG. 10, when the operation to control the surface potential of the drum 1 is started after the power is activated, at step #5, the transformer output control value is set to a set value A bit, and at step #10, the main chargers 2 are activated. The control value is counted in bits on the software. At step #15, a grid control signal is regulated so that a read-out value of the potential sensor (surface electrometer) 4 is a set value. When it is determined at step #20 that the drum surface potential at the portion where the potential sensor 4 detects the potential reaches the set value, the regulating operation is finished. When it is determined at step #20 that the drum surface potential at the portion where the potential sensor 4 detects the potential does not reach the set value only by the grid control, the drum surface potential is controlled to reach the set value by making a regulation based on the transformer output control value at step #25. When it is determined at step #30 that the drum surface potential at the potential detected portion does not reach the set value even though this regulation is made, a service man call warning is displayed at step #35 since repair or adjustment is necessary.

Subsequently, an embodiment shown in FIGS. 11 to 13 will be described. This embodiment uses an amorphous silicon material. In a copying machine having a drum using such a photosensitive material, when a copying process in which an electrostatic latent image is locally erased by turning on the blank lamp 5 is continuously executed, the reduced surface potential at an image erased portion of the last copying process on the drum surface is not recovered during charging, so that the surface potential is low at that portion compared to the other portions. As a result, the potential on the drum surface is non-uniform. In this embodiment, this problem is solved.

Figures 13A, 13B, 13C:
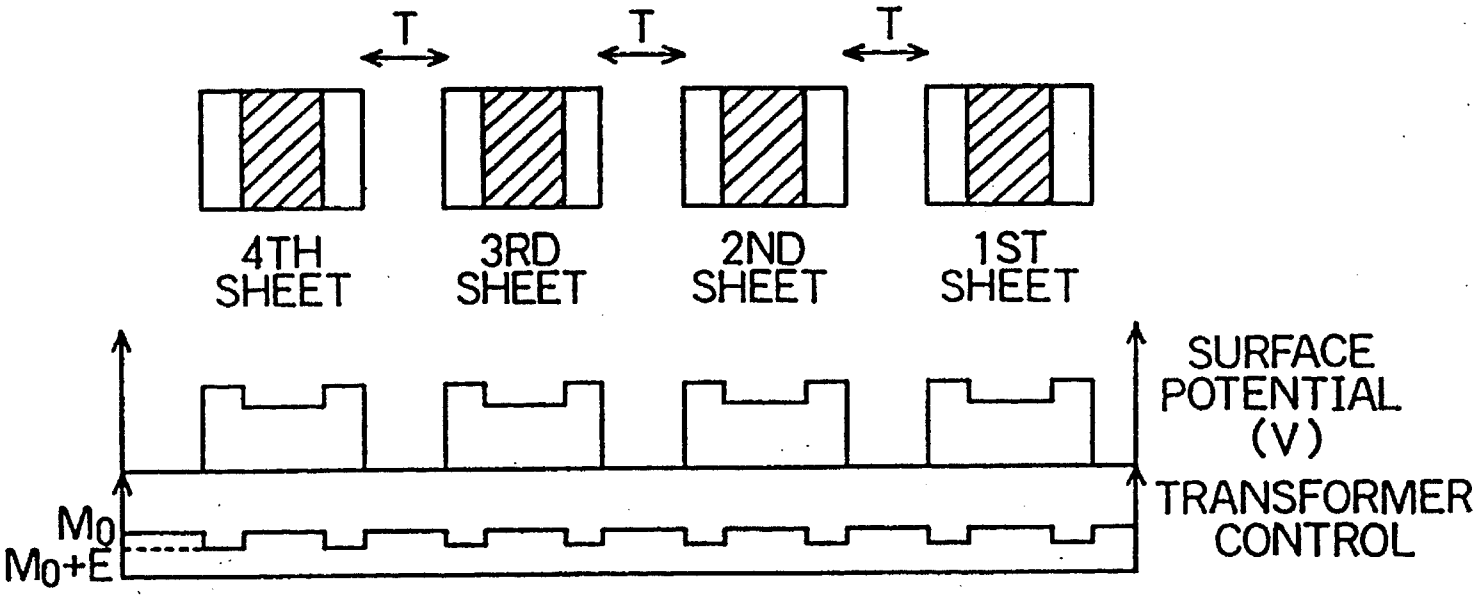
FIG. 13 is a view of assistance in explaining its operation.

During continuous copying in which a plurality of sheets are fed at a predetermined timing, as shown in (a) of FIG. 13, when the blank lamp 5 is turned on during a paper feeding interval T, the surface potential of the area of the drum surface corresponding to the interval is optically attenuated as shown in (b) of FIG. 13. The surface potential of the optically attenuated portions (hatched portions) where the surface potential is low does not increase to a necessary surface potential at the next charging, so that the portions becomes the low potential areas. According to a relationship between the low potential areas and the sheet size, the low potential areas may overlap the image formed area during the next and succeeding copying processes. In this case, a necessary amount of toner does not adhere to the electrostatic latent image portion which overlaps the low potential areas during development, so that a non-uniform image is formed on the sheet on which the image has been copied and the density of the image is partly low.

Figure 11:
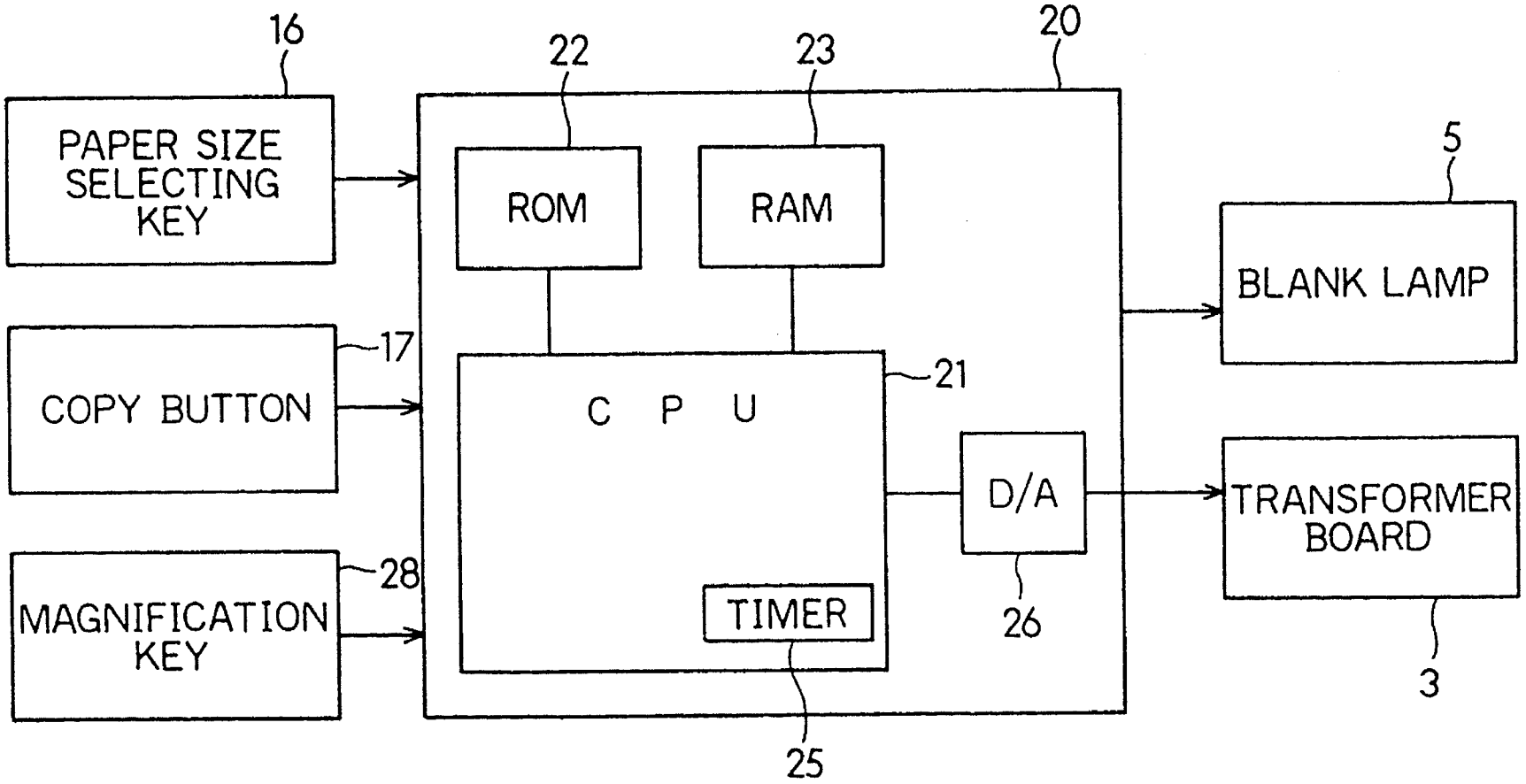
FIG. 11 is a block diagram showing a control system and an operation system of still another embodiment of the present invention.

Referring to FIG. 11, there are shown the control system and the operation system of this embodiment. Reference numeral 16 represents a paper selecting key used to select a paper size among various sizes. Reference numeral 17 represents a copy button used to start a copying operation. Reference numeral 28 represents a magnification key used to set an enlargement rate or a reduction rate.

By operating the paper size selecting key 16 and the magnification key 17, the interval of feeding of the sheets P is set while the drum 1 is rotating at a constant peripheral speed. Thereafter, by pressing the copy button 17, the copying process is executed, so that an image is copied to the image formed area of the sheet P of an arbitrarily selected size at an arbitrarily selected magnification.

Reference numeral 20 represents a main circuit board provided with a microcomputer. The main circuit board 20 is provided with a central processing unit (CPU) 21, a read only memory (ROM) 22 and a random access memory (RAM) 23 for inputting and outputting control data to the CPU 21. In the CPU 21, a timer 25 for counting a predetermined period of time based on a signal for detecting the turning on of the blank lamp 5, for example, an all ON detecting signal for the sheet-to-sheet charge removal are arranged in the form of software.

During charging after the start of the copying process performed by turning on the blank lamp 5, the CPU 21 controls the program so that a transformer output control signal for increasing an output value of the main transformer board 3 by a predetermined correction value in synchronism with the ON period of the blank lamp 5 based on input data from the paper size selecting key 16, the magnification key 28 and the copy button 17 is transmitted to the main transformer board 3 through a D/A converter 26 incorporated in the main circuit board 20, so that the area of the drum surface corresponding to the ON period of the blank lamp 5 (hereinafter referred to as "blanked area") is charged to a potential the same as a potential at which the image formed area other than the blanked area is charged.

The relationship between the digital data input value and the analog output value from the CPU 21 at the D/A converter 26 is the same as that of FIG. 4.

The relationship between the D/A-converted transformer output control signal and the transformer output of the main transformer board 3 is the same as that of FIG. 5.

Figure 12:
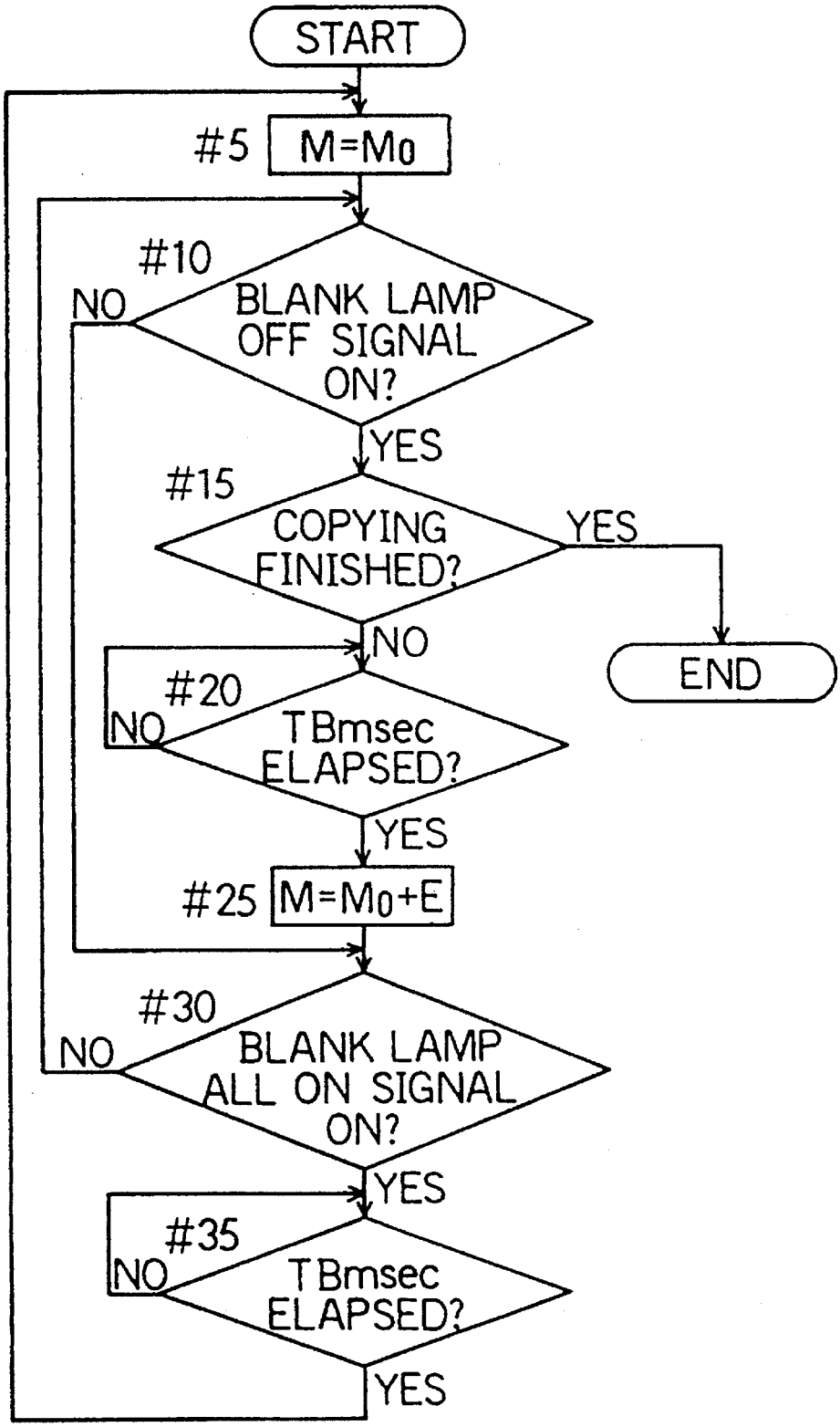
FIG. 12 is the flowchart of its control operation.

Referring to FIG. 12, there is shown the flow of a control operation performed by the CPU 21 of the main circuit board 20. As shown in the figure, when the copy button 17 is turned on to start a continuous copying operation, at step #5, a control value M of the transformer output set in bits as a digital value is set as a set control value $M_0$ of a predetermined transformer output. The main transformer board 3 is controlled by this control value.

When it is determined at step #15 that a signal for turning off the blank lamp 5 is disabled and it is determined at step #30 that a latch signal for turning on all the LED arrays of the blank lamp 5 is activated to remove the charge of the portion between the last and present images, the process proceeds to step #35. When a time value TBmsec (e.g. 613 msec) depending on the paper feeding interval and the peripheral speed of the drum has elapsed at step #30, the process returns to step #5 to set the set control value $M_0$ of the transformer output as the output value M of the transformer output control signal and apply a voltage to the chargers 2 with a transformer output corresponding to the control output value $M_0$ as shown in (c) of FIG. 13.

When it is determined at step #10 that a signal for turning off the blank lamp 5 is activated and it is determined at step #15 that the copying process is continued, after the time TBmsec is elapsed (step #20), at step #25, a value E depending on the drum characteristic set in bits is added to M. Then, the transformer control value ($M_0$+E) is outputted.

As shown in (c) of FIG. 13, the value E depending on the drum characteristic coincides with a control value corresponding to the potential reduction at the optically attenuated low surface potential areas (hatched portions) of the area of the drum surface corresponding to the ON period of the blank lamp 5, and is a variable value corresponding to the characteristics of the photosensitive layer of the drum 1.

Until the blank lamp all ON signal is activated at step #30 and the continuous copying is finished, during charging, an operation to charge the blanked area of the drum surface corresponding to the ON period of the blank lamp at a potential the same as a potential at which the image formed area other than the blanked area is repeated by setting the output value M of the main circuit board 20 to $M_0$+E in synchronism with the 0N period of the blank lamp 5.

The drum surface potential at the charging section A is controlled by regulating the voltage to the main wire 2*b* by transmitting a control signal from the main circuit board 20 to the transformer board 3 so that the drum surface potential is a predetermined value (e.g. 820V) at the developing section C. The grid voltage may be regulated instead of regulating the voltage to the main wire 2*b*. In that case, the grid potential control signal is transmitted from the main circuit board 20 to the grid board 27. According to this embodiment, the blanked area of the surface of the electrostatic latent image carrier corresponding to the ON period of the blank lamp is charged to a potential the same as a potential at which the image formed area other than the blanked area is charged, so that the potential at the surface of the electrostatic latent image carrier is uniform.

Thus, in an apparatus of a type where the electrostatic latent image carrier has a photosensitive layer made of a photosensitive material having a low rise, even when the image formed area of the sheet and the moving area of the electrostatic latent image carrier corresponding to the ON period of the blank lamp overlap each other according to a relationship between the blanked area and the paper size, the surface potential reduction at the blanked area is effectively corrected, so that no density difference is caused between the portion and the other portions, and an excellent image quality is always realized. This advantage cannot be obtained by the prior arts.

Obviously, many modifications and variations of the present invention are possible in light of the above teachings. It is therefore to be understood that within the scope of the appended claims, the invention may be practiced other than as specifically described.

TABLE 1

| | Cm | | | | Inch |
|---|---|---|---|---|---|
| Large size | A3 | B4 | Folio | | 11 × 17 |
| Small size | A4R | A4 | B5 | 8½ × 14 | 8½ × 11 |
| | B5R | A5R | | 11 × 8½ | 5½ × 8½ |

What is claimed is:

1. An image forming apparatus comprising:

an electrostatic latent image carrier having a photosensitive layer formed on its surface, said electrostatic latent image carrier moving from a charging section by way of an exposing section, a developing section and a charge removing section in this order to return to the charging section;

a charger provided in the charging section;

a voltage applying means for applying to the charger a voltage for supplying a potential to the surface of the electrostatic latent image carrier;

an operation means for starting an image forming operation;

means for performing arbitrary times an image forming processing, the processing including steps for charging the surface of the electrostatic latent image carrier by the charger in response to an operation of the operation means, for forming an electrostatic latent image on a charged surface of the electrostatic latent image carrier at the exposing section, for developing the electrostatic latent image into a toner image at the developing section, and for getting ready for a next charging by charge-removing the surface of the electrostatic latent image carrier at the charge removing section;

controlling means for correcting an output value of the voltage applying means to a voltage value necessary for the surface of the electrostatic latent image carrier to be charged at a stable potential level in a predetermined number of charging operations performed until a surface potential of the electrostatic latent image carrier increases from a low potential to a predetermined stable potential after a start of the image forming processing; and detecting means for detecting a length of a left period from an end of a last image forming processing to a start of a present image forming processing;

wherein said control means corrects the output value of the voltage applying means by adding a correcting value corresponding to said left period to a control signal which is directed to the voltage applying means.

2. An image forming apparatus according to claim 1, wherein said low potential being attributed to a rise characteristic of the surface potential of the electrostatic latent image carrier.

3. An image forming apparatus according to claim 1, wherein said low potential level being attributed to a rise characteristic of the surface potential of the electrostatic latent image carrier and varying according to a length of a left period from an end of a last image forming processing to a start of a present image forming processing.

4. An image forming apparatus according to claim 1, wherein said photosensitive layer formed on the surface of the electrostatic latent image carrier is made of an amorphous silicon photosensitive material.

5. An image forming apparatus comprising:

an electrostatic latent image carrier having a photosensitive layer formed on its surface, said electrostatic latent image carrier moving from a charging section by way of an exposing section, a developing section and a charge removing section in this order to return to the charging section;

a charger provided in the charging section;

a first voltage applying means for applying to the charger a voltage for supplying a potential to the surface of the electrostatic latent image carrier;

an operation means for starting an image forming operation;

means for performing arbitrary times an image forming processing, the processing including steps for charging the surface of the electrostatic latent image carrier by the charger in response to an operation of the operation means, for forming an electrostatic latent image on a charged surface of the electrostatic latent image carrier at the exposing section, for developing the electrostatic latent image into a toner image at the developing section, and for getting ready for a next charging by charge-removing the surface of the electrostatic latent image carrier at the charge removing section;

an electrode provided between the charger and the surface of the electrostatic latent image carrier;

a second voltage applying means for applying a voltage to the electrode;

controlling means for correcting an output value of the second voltage applying means for applying a voltage to the electrode to a voltage value necessary for the surface of the electrostatic latent image carrier to be charged by the charger at a stable potential level in a predetermined number of charging operations performed until a surface potential of the electrostatic latent image carrier increases from a low potential to a predetermined stable potential after a start of the image forming processing; and detecting means for detecting a length of a left period from an end of a last image forming processing to a start of a present image forming processing;

wherein said control means corrects the output value of the second voltage applying means by adding a correcting value corresponding to said left period to a control signal which is directed to the voltage applying means.

6. An image forming apparatus according to claim 5, wherein said low potential being attributed to a rise characteristic of the surface potential of the electrostatic latent image carrier.

7. An image forming apparatus according to claim 5, wherein said low potential being attributed to a rise characteristic of the surface potential of the electrostatic latent image carrier and varying according to a length of a left period from an end of a last image forming processing to a start of a present image forming processing.

8. An image forming apparatus according to claim 5, wherein said photosensitive layer formed on the surface of the electrostatic latent image carrier is made of an amorphous silicon photosensitive material.

9. An image forming apparatus comprising:

an electrostatic latent image carrier having a photosensitive layer formed on its surface, said electrostatic latent image carrier moving from a charging section by way of an exposing section, a developing section and a charge removing section in this order to return to the charging section;

a charger provided in the charging section;

a voltage applying means for applying to the charger a voltage for supplying a potential to the surface of the electrostatic latent image carrier;

means for performing arbitrary times an image forming processing, the processing including steps for forming at the exposing section an electrostatic latent image on the surface of the electrostatic latent image carrier charged by the charger, for developing the electrostatic latent image into a toner image at the developing section, and for getting ready for a next charging by charge-removing the surface of the electrostatic latent image at the charge removing section;

a blank lamp which erases an electrostatic latent image located outside an image formation area by generating a local charge-removing light; and controlling means for charging the surface of a blanked area of the electrostatic latent image carrier corresponding to the activation period of the blank lamp to a potential the same as a potential of an image formation area other than the blanked area by varying an output value of the voltage applying means in synchronism with an ON period of the blank lamp in a charging operation.

10. An image forming apparatus according to claim 9, wherein said photosensitive layer formed on the surface of the electrostatic latent image carrier is made of an amorphous silicon photosensitive material.

11. An image forming apparatus comprising:

an electrostatic latent image carrier having a photosensitive layer formed on its surface, said electrostatic latent image carrier moving from a charging section by way of an exposing section, a developing section and a charge removing section in this order to return to the charging section;

a charger provided in the charging section;

a voltage applying means for applying to the charger a voltage for supplying a potential to the surface of the electrostatic latent image carrier;

an operation means for starting an image forming operation;

means for performing arbitrary times an image forming processing, the processing including steps for charging the surface of the electrostatic latent image carrier by the charger in response to an operation of the operation means, for forming an electrostatic latent image on a charged surface of the electrostatic latent image carrier at the exposing section, for developing the electrostatic latent image into a toner image at the developing section, and for getting ready for a next charging by charge-removing the surface of the electrostatic latent image carrier at the charge removing section; and controlling means for correcting an output value of the voltage applying means to a voltage value necessary for the surface of the electrostatic latent image carrier to be charged at a stable potential level in a predetermined number of charging operations, said correcting being performed by said controlling means until a surface potential of the electrostatic latent image carrier is changed from a potential lower than a predetermined stable potential, which low potential is due to a rise characteristic of the surface potential of the electrostatic latent image carrier, up to an initial reaching of said predetermined stable potential during a start up stage of the image forming processing.

12. An image forming apparatus according to claim 11, wherein said photosensitive layer formed on the surface of the electrostatic latent image carrier is made of an amorphous silicon photosensitive material.

13. An image forming apparatus according to claim 11 further comprising;

detecting means for detecting a length of a left period from an end of a last image forming processing to a start of a present image forming processing, wherein said control means corrects the output value of the voltage applying means by adding a correcting value corresponding to said left period to a control signal which is directed to the voltage applying means.

* * * * *